US006024234A

United States Patent [19]

Rink et al.

[11] Patent Number: 6,024,234

[45] Date of Patent: Feb. 15, 2000

[54] CLOSURE DEVICE FOR A MEMBRANE SEALED CONTAINER

[75] Inventors: Julie E. Rink, Westerville; Thomas D. Loughrin, Columbus, both of Ohio

[73] Assignee: Abbott Laboratories, Abbott Park, Ill.

[21] Appl. No.: 09/188,736

[22] Filed: Nov. 9, 1998

[51] Int. Cl.[7] ..... B65D 39/00

[52] U.S. Cl. ..... 215/228; 215/250; 215/303

[58] Field of Search ..... 215/226, 228, 215/232, 250, 301, 302, 303

[56] References Cited

U.S. PATENT DOCUMENTS

| | | | |
|---|---|---|---|
| 4,634,013 | 1/1987 | Bar-Kokhba . | |
| 4,754,889 | 7/1988 | Debetencourt . | |
| 4,770,305 | 9/1988 | Su . | |
| 4,793,122 | 12/1988 | Towns et al. . | |
| 4,793,503 | 12/1988 | Towns et al. . | |
| 4,993,569 | 2/1991 | Osip et al. . | |
| 5,082,136 | 1/1992 | Schumann . | |
| 5,090,582 | 2/1992 | Art et al. . | |
| 5,255,812 | 10/1993 | Hsu . | |
| 5,255,813 | 10/1993 | Berggren et al. . | |
| 5,477,972 | 12/1995 | Lester . | |
| 5,505,326 | 4/1996 | Junko . | |
| 5,791,505 | 8/1998 | Gilliland | 215/228 |
| 5,797,506 | 8/1998 | Lenmkuhl et al. | 215/228 |

*Primary Examiner*—Stephen K. Cronin
*Attorney, Agent, or Firm*—Brian R. Woodworth; Daniel J. Hulseberg

[57] ABSTRACT

The invention comprises a cap member having an annular wall and a top wall disposed within and connected to the annular wall. An arcuate pierce-plow member is disposed on an upper surface of the top wall at a position spaced from the annular wall. The pierce-plow member includes a first plow base member having a ramp portion and a substantially flat portion. The pierce-plow member further includes a piercing member disposed adjacent to the substantially flat portion of the plow base member. The piercing member includes a first portion disposed adjacent to the first plow base member and a second portion disposed at a position spaced from the first plow base member. A thickness of the second portion of the piercing member is greater than a thickness of the first portion of the piercing member.

11 Claims, 2 Drawing Sheets

CLOSURE DEVICE FOR A MEMBRANE SEALED CONTAINER

TECHNICAL FIELD

The invention relates generally to a closure device for membrane sealed containers and more specifically to an improved closure device constructed to open the mouths of membrane sealed containers.

BACKGROUND OF THE INVENTION

Membrane sealed containers are finding widespread commercial use as consumer health and safety considerations continue to rise. In order to prevent undetectable tampering or accidental spillage of medicine, foodstuffs, cleaning products, automotive, and lawn and garden products in either a liquid or solid, the product is encased in a membrane-sealed glass or plastic container. In many instances it is desirable that the sealed container be opened without a person's hands coming into contact with the material inside the container, and without the need for additional tools.

It may also be important that the membrane not break off and fall into the contents of the bottle after it is opened. It may further be important to be able to reseal the bottle if it is not completely emptied after use (or after partial use of its contents).

Various devices have been used to open membranes of the type discussed herein, such devices including those disclosed in U.S. Pat. No. 4,634,013 which includes a cutting device. U.S. Pat. No. 5,505,326 discloses a cap having a plurality of cutters which puncture the membrane requiring that the consumer tear-out the remaining membrane. U.S. Pat. No. 5,090,582 discloses a cap including a cutting device which incorporates a plow base member along its sidewall, thereby preventing the membrane from falling into the container after it has been cut. U.S. Pat. No. 4,993,569 discloses a piercing closure device wherein, prior to opening the cap, the consumer presses down on the cap and thereby pierces the membrane. U.S. Pat. No. 3,887,099 discloses a cap having internal cutters whereby the membrane is cut along its edges when a consumer pushes down on the cap.

SUMMARY OF THE INVENTION

The present invention is directed to a closure device for a container having an opening that is sealed with a membrane seal. The closure device of the present invention is provided in the form of a cap member having a lower sealing surface construct to seal fluidly the container. The closure further includes an upper surface having a pierce/plow member disposed thereon. The pierce/plow member is designed to pierce and tear the membrane as the cap is rotated relative to the container, thereby providing a fluid flow orifice for the contents of the container.

It is an object of the invention to provide a system for opening a membrane-sealed container which is embodied in a cap member for closing the container.

It is an object of the invention to provide a system for opening a membrane-sealed container that may be used by both a left and a right-handed consumer.

It is another object of the invention to provide a system for opening a membrane-sealed container that is not complicated to use.

It is a further object of the invention to provide a system for opening a membrane-sealed container such that the membrane remains connected to the container after use of the system, i.e., a system that does not allow the membrane to fall into the container after the membrane is cut by the system.

It is also an object of the invention to provide a system for opening a membrane-sealed container that is relatively simple and inexpensive to manufacture.

Additional objects, advantages and novel features of the invention will be set forth in part in the detailed description which follows, and in part will become apparent to those skilled in the art upon examination of the description contained herein, or may be learned by practice of the invention. The objects and advantages of the invention may be realized and attained by means of the instrumentalities and combinations particularly pointed out in the appended claims.

To achieve the foregoing and other objectives, and in accordance with the purpose of the present invention as embodied and broadly described herein, the system for opening a membrane-sealed container includes a cap member having a lower sealing surface for fluidly sealing a container. The cap body further includes an upper surface having a pierce-plow member having a predetermined length. The pierce-plow member includes an upper piercing point and a lower plow base member portion.

BRIEF DESCRIPTION OF THE DRAWINGS

The accompanying drawings, which are incorporated in and form part of the specification, illustrate an embodiment of the present invention and, together with the description, serve to explain the principles of the invention. In the drawings.

DETAILED DESCRIPTION OF THE INVENTION

Figure 1:
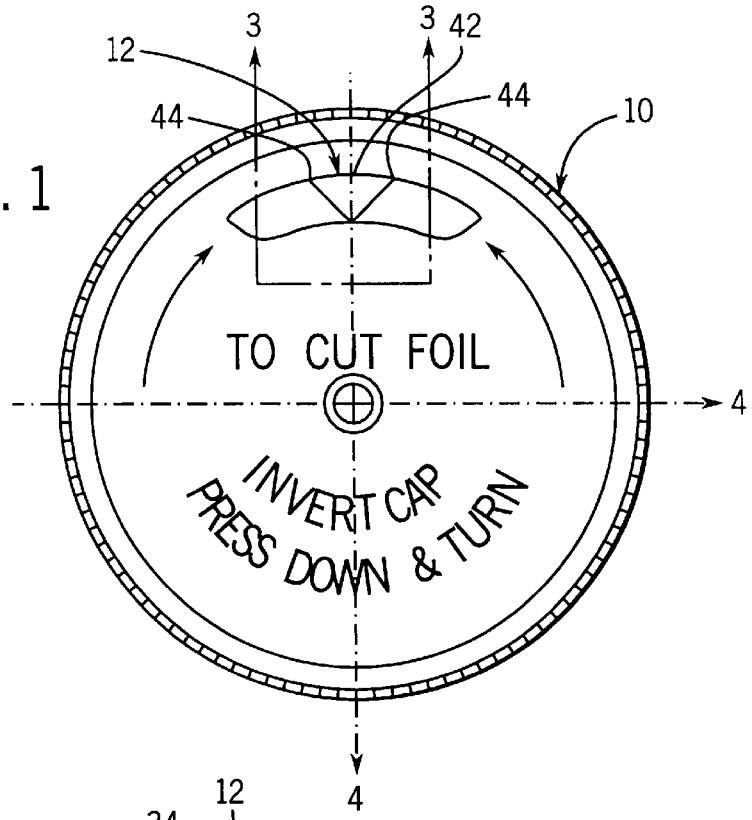
FIG. 1 shows a top view of the invention.

Referring to the accompanying figures, the closure device of the present invention is provided in the form of a cylindrical cap member generally indicated at 10 in FIG. 1. In the embodiment of the present invention depicted in the accompanying figures, cap member 10 includes an annular wall 11 having a first end portion 30 and a second end portion 32. Cap member 10 further includes a top wall 34 disposed within annular wall 11 such that top wall 34 is positioned between first end portion 30 and second end portion 34 so as to define a first, sealing cavity 6 and a second, opening cavity 5. An outer surface 13 of annular wall 11 is provided with ridges in order to facilitate the gripping thereof by a user. Surface 36 of top wall 34 is constructed to face an associated container when cap member 10 is in its sealing position. Surface 36 of top wall 34 faces away from the associated container when cap member 10 is in its opening position. Cap member 10 preferably is constructed to seal fluidly a container with which cap member 10 is intended to be used. For example, surface 36 can be constructed to cooperate with the associated container in order to provide a fluid-tight seal therebetween.

The embodiment of cap member 10 depicted herein, cap member 10 is constructed to seal and to open a container having a circular pour orifice that is fluidly sealed by a fluid-impervious membrane, e.g., foil or plastic. It will be appreciated that the specific configuration of cap member 10 will vary dependent upon the configuration of the container with which it is to be used. For example, the diameter of cap member 10 can be varied to match variations in the diameter of the container with which cap member 10 is to be used. Further, if the container has a pour orifice with a non-circular shape, cap member 10 will preferably be reconfigured in order to provide the functional and structural characteristics discussed in detail herein.

Figure 2:
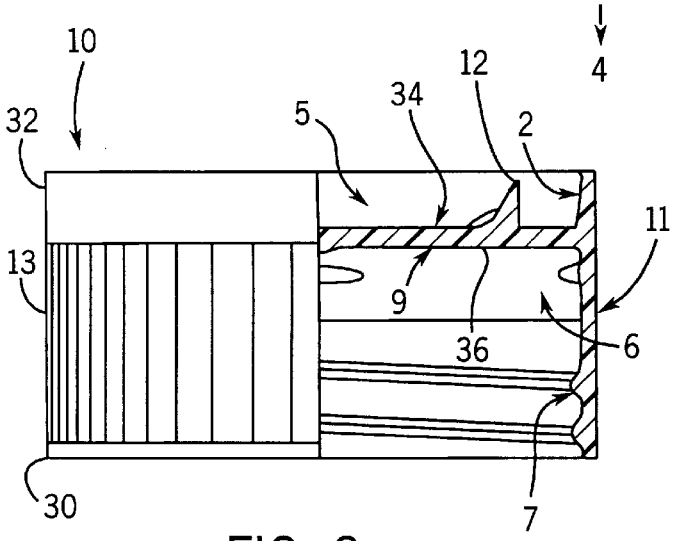
FIG. 2 shows a sectional side view of the invention.

In the embodiment of the present invention depicted in FIG. 2, threads 7 are provided on an interior surface of annular wall 11, threads 7 being configured to provide a threaded connection between cap member 10 and a container. It will be appreciated that threads 7 can have a variety of known configurations. It also will be appreciated that threads 7 can be omitted if no threads are present on the container. Finally, it will be appreciated that alternate, known retention devices can be used in lieu of threads 7 in order to secure cap member 10 to an associated container. For example, cap member 10 can be constructed to provide a snap fit with the associated container using known structures.

A pierce-plow member 12 is attached to an upper surface 8 of top wall 34. Pierce-plow member 12 is constructed to pierce and tear a membrane seal 25 on the associated container 23. It will be appreciated that the precise dimensions of pierce-plow member 12 will vary dependent upon a variety of factors. For example, the configuration of the pierce-plow member 12 will need to address factors such as the thickness of the materials used in the membrane 25 that seals the associated container 23. Further, the configuration of the pierce-plow member 12 will vary dependent upon the materials used to construct cap member 10 and pierce-plow member 12. In addition, the height and thickness of pierce-plow member 12 will have to be varied based upon the depth and configuration of second, opening cavity 5.

Figure 3:
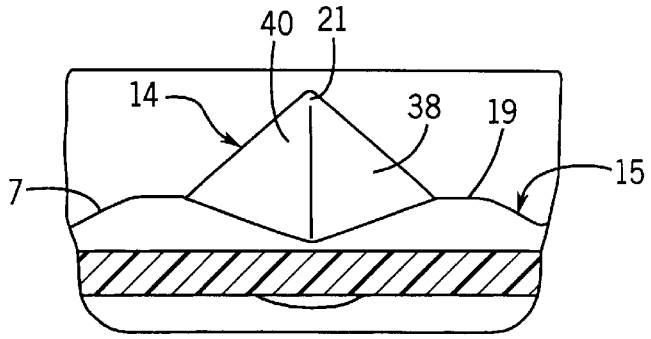
FIG. 3 shows a detail of the cutter taken along 3—3 of FIG. 1.

The geometry of the pierce-plow member 12 preferably is selected to provide pre-tensioning of the membrane that seals the container. It is believed that an enhanced cutting/tearing effect is achieved if the membrane is placed in a stressed condition prior to the application of a cutting force. In the embodiment of the present invention depicted in FIG. 3, plow base member 15 provides the desired pre-tensioning of the membrane. Plow base member 15 includes a ramp portion 17 and a substantially flat portion 19. Pierce-plow member 12 further includes piercing member 21 positioned adjacent to substantially flat portion 19. Piercing member 21 is constructed such that it is capable of piercing the membrane closure 25 on an associated container 23 when cap member 10 is urged axially towards the associated container. Piercing member 21 also is constructed such that it is capable of tearing the membrane closure 25 upon relative rotation of cap member 10 and the associated container 23.

In the embodiment of the present invention depicted herein, pierce-plow member 12 includes two plow base members 15, i.e., one plow base member 15 on either side of piercing member 21. This symmetrical configuration allows pierce-plow member 12 to be used by both left and right handed individuals.

Pierce-plow member 12 preferably has a radius of curvature when cap member 10 is constructed for use with containers having circular pour orifices. The arc length of pierce-plow member 12 can be varied dependent upon the desired functional characteristics of pierce-plow member 12. However, in a preferred embodiment of the present invention, a single pierce-plow member 12 having a limited (<90°) arc length is employed. Such a configuration reduces the volume, and thus the cost, of the materials used to construct cap member 10. In the depicted embodiment, pierce-plow member 12 defines an arc of approximately 45°. Further, although this configuration of cap member 10 requires an operator to impart substantially 360° of relative rotational movement between cap member 10 and the associated container 23 in order to create the desired opening in the container's membrane seal 25, it has been found that this configuration of pierce-plow member 12 does not produce a 360° tear of the membrane seal 25. Rather, it has been found that this configuration consistently leaves a small flap of the membrane seal 25 intact, thereby ensuring that the torn portion of the membrane seal 25 does not fall into the interior of the associated container 23. It is believed that the small flap of the membrane seal 25 that is not torn by pierce-plow member 12 remains intact because it is not possible to provide a sufficient pre-stressing of those portions of the membrane 25 that are substantially adjacent to the point at which piercing member 21 originally pierced the membrane. Instead, these portions of the membrane 25 simply move away from pierce-plow member 12 as relative rotation is effected between cap member 10 and container 23.

Figure 4:
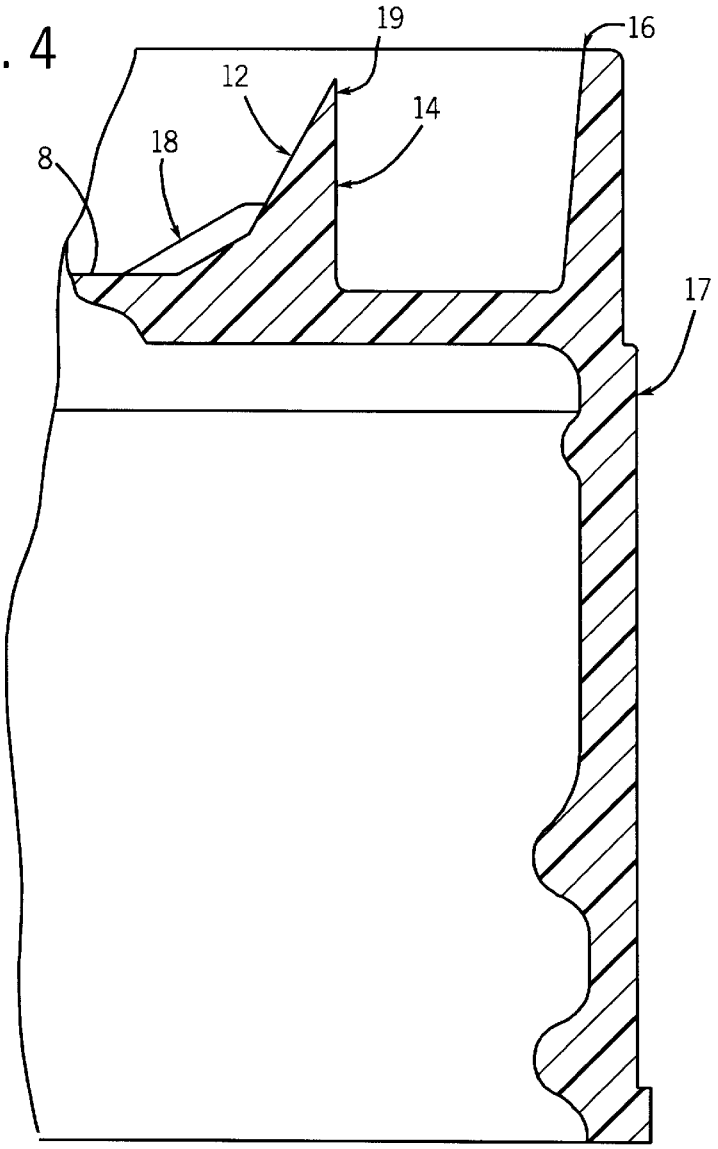
FIG. 4 shows a detail sectional view of the invention taken at 4—4 of FIG. 1.

FIG. 4 provides an exploded, cross-sectional view of cap member 10 and pierce-plow member 12. As above-discussed, pierce plow member 12 is in the form of an arc. Pierce plow member 12 includes a back wall 14 which preferably is concentric to annular wall 11 along its length. Back wall 14 preferably is spaced from annular wall 11 to receive therebetween the wall of container 25 defining the pour orifice 27 of container 25. It has been found to be preferable that the distance between back wall 14 and annular wall 11 be at least as great as the thickness of the wall of the container 25 at the pour orifice 27, thereby ensuring that back wall 14 can be positioned radially inwardly from the container wall when annular wall 11 is positioned radially outwardly from the container wall.

It will be appreciated that piercing member 21 must withstand greater forces than plow base member portion 15. That is, the forces associated with the piercing and tearing of the membrane seal 25 on the associated container 23 are greater than the forces associated with the pre-stressing of membrane seal 25 performed by the plow base member portion. Further, it will be appreciated that piercing member 21 extends further from upper surface 8 of top wall 34 than does plow base member portion 15. For these reasons, it has been found to be preferable to construct pierce-plow member 12 such that the thickness of piercing member 21 (i.e., its radial thickness) is greater than the thickness of the plow base member portion 15 at certain positions spaced from upper surface 8, as depicted in the accompanying figures. One of ordinary skill in the art will recognize that piercing member 21 and plow base member portion 15 can have the same thickness, while simultaneously providing the desired structural integrity to piercing member 21, without departing from the intended scope and spirit of the present invention. However, it is believed that this configuration would result in an unnecessary use of material in the formation of plow base member portion 15, thereby increasing the cost of manufacture associated with cap member 10.

The height of the piercing member 21 preferably is selected such that it does not extend beyond the second end portion 32 of annular wall 11, thereby preventing inadvertent harm to an individual using the cap member 10 of the present invention. In the depicted embodiment, the height of piercing member 21 has been selected such that it is disposed within second, opening cavity 5, i.e., such that the tip of piercing member 21 is below the upper edge of annular wall 11. In addition, as above-discussed, the pierce-plow member 12 is spaced from the annular wall 11 in order to ensure that the cut made by the piercing member 21 is made at a position that is radially inward from the inner surface of the bottle.

In addition to back wall 14, piercing member 21 includes first face 38 and second face 40. First and second faces 38, 40 of piercing member 21 are constructed such that piercing member 21 has a greater radial dimension at its center 42 than at its edge 44. As a result of this configuration, edge 44 of piercing member 21 provides the initial cutting of member 25 because it is the first portion of piercing member 21 that contacts membrane 25 after membrane 25 is prestressed by plow base member 15. As further, relative rotation is imparted between cap member 10 and container 23, one of first face 38 and second face 40 (depending upon the direction of the relative rotation) will provide further tearing and separation of membrane 25. This configuration of piercing member 21 has been found to provide the desired tearing or cutting of membrane 25.

Figure 5:
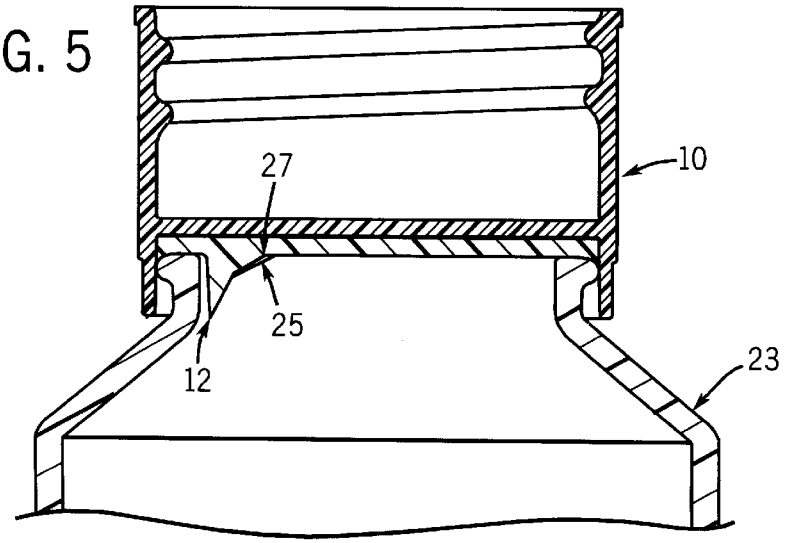
FIG. 5 depicts sectional view of the invention opening the membrane sealed container.

FIG. 5 shows the cap member 10 of the present invention in an inverted, operative position relative to container 23 having pierceable membrane 25 which fluidly seals pour orifice 27. In this position, the upper portion of container 23 is positioned within second, opening cavity 5. This orientation of cap member 10 relative to container 23 is achieved by disconnecting, e.g., unscrewing or unsnapping, cap member 10 from container 23 and inverting cap member 10 relative to container 23. FIG. 5 depicts cap member 10 after piercing member 21 has been urged through pierceable membrane 25 and into the interior of container 23. Placement of cap member 10 in the depicted position requires the application of a force that causes the upper portion of container 23 to be urged further into second, opening cavity 5. It will be appreciated that the required force can be achieved by applying force to one or both of cap member 10 and container 23.

After piercing member 21 has pierced membrane 25 and cap member 10 is in the position depicted in FIG. 5, further opening of container 23 is achieved by effecting relative rotation between cap member 10 and container 23. In the embodiment of the present invention in which plow base member portions 15 are provided on each side of piercing member 21, such relative rotation can be effected in either direction. As above-discussed, during relative rotation between cap member 10 and container 23, plow base member portion 15 applies a pre-stressing to membrane 25, thereby facilitating a cutting or tearing of membrane 25 by piercing member 21. Further, the configuration of piercing member 21, including first and second faces 38, 40, causes membrane 25 to be efficiently cut by piercing member 21 upon relative rotation between cap member 10 and container 23, provided that cap member 10 and container 23 are not permitted to move axially away from one another during such relative rotation. Also as above-discussed, the configuration of cap member 10, and particularly the configuration of pierce-plow member 12, will not result in a 360° tear of membrane 25, thereby ensuring that the torn portion of membrane 25 will not fall into the interior of container 23. That is, a small segment of membrane 25 coming into contact with pierce-plow member 12 will not be cut, thereby leaving a flap of membrane 25 that can be pushed into or pulled from container 23. It is believed that this segment of membrane 25 is not cut because a sufficient pre-stressing is not possible for those portion of membrane 25 that lie next to the point at which piercing member 21 initially pierced membrane 25.

Use of the system of the present invention, although apparent from the foregoing discussion, will now be summarized. In order to seal fluidly a container 23 having a pierceable membrane 25, cap member 10 is attached to container 23 such that container orifice 27 is positioned within first, sealing cavity 6 defined by annular wall 11. When it is desired to open container 23 and dispense the contents therefrom, cap member 10 is detached from container 23 and inverted relative thereto such that second, opening cavity 5 is directed toward container 23. Cap member 10 and container 23 are then moved toward one another such that piercing member 21 is urged through membrane 25. Thereafter, relative rotation is imparted between cap member 10 and container 23, while maintaining the axial orientation of cap member 10 and container 23, in order to effect a circumferential tearing of membrane 25. As above-discussed, 360° relative rotation produces a flap of membrane 25 that is connected to the remainder of membrane 25 by way of a relatively narrow strip. The resulting flap of membrane 25 can be pushed inwardly or pulled outwardly in order to facilitate the dispensing of the contents of container 23 through pour orifice 27. The resulting flap of membrane 25 also can be removed by tearing it from the remainder of membrane 25.

The foregoing description of the preferred embodiment of the invention has been presented for purposes of illustration and description. It is not intended to be exhaustive or to limit the invention to the precise form disclosed, and one of ordinary skill in the art will recognize that many modifications and variations are possible in light of the above teaching. It is intended that such modifications and variations be within the scope and spirit of the present invention, such scope and spirit being defined by the appended claims.

What is claimed is:

1. A closure device for a membrane sealed container, said closure device comprising:

an annular wall;

a top wall disposed within and connected to said annular wall, said top wall having an upper surface; and a pierce-plow member disposed on said upper surface of said top wall at a position spaced from said annular wall, said pierce-plow member being arcuate, said pierce-plow member comprising:

a first plow base member having a ramp portion and a substantially flat portion; and a piercing member disposed adjacent to said substantially flat portion of said plow base member, said piercing member having a first portion disposed adjacent to said first plow base member and a second portion disposed at a position spaced from said first plow base member, a thickness of said second portion of said piercing member being greater than a thickness of said first portion of said piercing member.

2. A closure device in accordance with claim 1, wherein said annular wall defines a thread constructed to enable threaded attachment of said closure device to a container.

3. A closure device in accordance with claim 1, wherein said pierce-plow member has an arc length of less than 90°.

4. A closure device in accordance with claim 3, wherein said pierce-plow member has an arc length of approximately 45°.

5. A closure device in accordance with claim 1, wherein said pierce-plow member further comprises a second plow base member having a ramp portion and a substantially flat portion, said piercing member being disposed between said first and second plow base members, said piercing member being disposed adjacent said substantially flat portions of said first and second plow base members, said piercing member having a third portion adjacent said second plow base member, a thickness of said third portion being less than said thickness of said second portion of said piercing member.

6. A closure device in accordance with claim 5, wherein said pierce-plow member has an arc length of less than 90°.

7. A closure device in accordance with claim 1, wherein said thickness of said piercing members increases constantly from said first portion to said second portion.

8. A container comprising:

a container body defining a pour orifice, said pour orifice fluidly sealed by a pierceable membrane; and a cap member constructed for attachment to said container body adjacent said pour orifice, said cap member comprising:

an annular wall;

a top wall disposed within and connected to said annular wall, said top wall having an upper surface; and a pierce-plow member disposed on said upper surface of said top wall at a position spaced from said annular wall, said pierce-plow member being arcuate, said pierce-plow member comprising:

a first plow base member having a ramp portion and a substantially flat portion; and a piercing member disposed adjacent to said substantially flat portion of said plow base member, said piercing member having a first portion disposed adjacent to said first plow base member and a second portion spaced from said first plow base member, a thickness of said second portion being greater than a thickness of said first portion of said first plow base member.

9. A closure device in accordance with claim 8, wherein said pierce-plow member further comprises a second plow base member having a ramp portion and a substantially flat portion, said piercing member being disposed between said first and second plow base members, said piercing member being disposed adjacent said substantially flat portions of said first and second plow base members, said piercing member having a third portion adjacent said second plow base member, a thickness of said third portion being less than said thickness of said second portion of said piercing member.

10. A closure device in accordance with claim 8, wherein said pierce-plow member has an arc length of less than 90°.

11. A closure device in accordance with claim 8, wherein said thickness of said piercing member increases constantly from said first portion to said second portion.

* * * * *